US009990880B2

(12) United States Patent
Zhang

(10) Patent No.: US 9,990,880 B2
(45) Date of Patent: Jun. 5, 2018

(54) PIXEL UNIT REDUCING VOLTAGE STRESS APPLIED TO DRIVING TRANSISTOR, PIXEL CIRCUIT HAVING THE PIXEL UNIT AND DRIVING METHOD THEREOF

(71) Applicants: BOE Technology Group Co., Ltd., Beijing (CN); HEFEI XINSHENG OPTOELECTRONICS TECHNOLOGY CO., LTD., Hefei (CN)

(72) Inventor: Yuting Zhang, Beijing (CN)

(73) Assignees: BOE Technology Group Co., Ltd., Beijing (CN); Hefei Xinsheng Optoelectronics Technology Co., Ltd., Hefei (CN)

( * ) Notice: Subject to any disclaimer, the term of this patent is extended or adjusted under 35 U.S.C. 154(b) by 57 days.

(21) Appl. No.: 14/417,456

(22) PCT Filed: Jun. 30, 2014

(86) PCT No.: PCT/CN2014/081127
§ 371 (c)(1),
(2) Date: Jan. 26, 2015

(87) PCT Pub. No.: WO2015/043266
PCT Pub. Date: Apr. 2, 2015

(65) Prior Publication Data

US 2015/0379928 A1 Dec. 31, 2015

(30) Foreign Application Priority Data

Sep. 30, 2013 (CN) ..... 2013 1 0461039

(51) Int. Cl.
*G09G 3/30* (2006.01)
*G09G 3/3233* (2016.01)
(Continued)

(52) U.S. Cl.
CPC ..... *G09G 3/3233* (2013.01); *G09G 3/3225* (2013.01); *G09G 3/3266* (2013.01);
(Continued)

(58) Field of Classification Search
CPC ..... G09G 3/12–3/14; G09G 3/30–3/3291
See application file for complete search history.

(56) References Cited

U.S. PATENT DOCUMENTS 5,206,631 A * 4/1993 Yamamoto ..... G09G 3/30 315/169.3
2002/0167472 A1 11/2002 Jinno
(Continued)

FOREIGN PATENT DOCUMENTS

CN 1383116 A 12/2002
CN 1779765 A 5/2006
(Continued)

OTHER PUBLICATIONS

Feb. 2, 2015—(CN)—First Office Action Appn 201310461039.9 with English Tran.
(Continued)

*Primary Examiner* — Sanghyuk Park
(74) *Attorney, Agent, or Firm* — Banner & Witcoff, Ltd.

(57) ABSTRACT

Provided is a pixel unit, a pixel circuit comprising the pixel unit and a driving method thereof. The pixel unit comprises a light-emitting element and n driving sub-circuits; wherein n is a natural number and n>1; each of the driving sub-circuits comprises a scan signal line for control-electrode, a switching transistor and a driving transistor; the switching transistor has a control electrode connected to the scan signal line for control-electrode, a first electrode connected to a data line, and a second electrode connected to a control electrode of the driving transistor; the driving transistor has a first electrode connected to a power supply line and a
(Continued)

second electrode connected to a first electrode of the light-emitting element; and a second electrode of the light-emitting element is connected to a reference voltage terminal.

15 Claims, 5 Drawing Sheets

(51) Int. Cl.
*G09G 3/3225* (2016.01)
*G09G 3/3266* (2016.01)

(52) U.S. Cl.
CPC ..... *G09G 2300/0809* (2013.01); *G09G 2300/0819* (2013.01); *G09G 2300/0842* (2013.01); *G09G 2300/0861* (2013.01); *G09G 2310/0251* (2013.01); *G09G 2310/0262* (2013.01); *G09G 2320/043* (2013.01); *G09G 2330/04* (2013.01)

(56) References Cited

U.S. PATENT DOCUMENTS

| | | | | |
|---|---|---|---|---|
| 2004/0196218 | A1* | 10/2004 | Senda | G09G 3/3233 345/76 |
| 2005/0134536 | A1* | 6/2005 | Lo | G09G 3/3266 345/76 |
| 2006/0125807 | A1 | 6/2006 | Park et al. | |
| 2006/0208658 | A1* | 9/2006 | Kim | G09G 3/3216 315/169.3 |
| 2006/0279489 | A1* | 12/2006 | Ouchi | G09G 3/20 345/76 |
| 2008/0036710 | A1 | 2/2008 | Kim | |
| 2008/0284691 | A1 | 11/2008 | Chung et al. | |
| 2009/0295772 | A1 | 12/2009 | Kim et al. | |

FOREIGN PATENT DOCUMENTS

| | | | |
|---|---|---|---|
| CN | 101572054 | A | 11/2009 |
| CN | 101593767 | A | 12/2009 |
| CN | 102856321 | A | 1/2013 |
| CN | 103489404 | A | 1/2014 |
| CN | 203456072 | U | 2/2014 |
| EP | 1887552 | A1 | 2/2008 |
| EP | 2531996 | A1 | 12/2012 |

OTHER PUBLICATIONS

Apr. 5, 2016—International Preliminary Report on Patentability Appn PCTCN2014081127.
International Search Report and Written Opinion dated Sep. 2, 2014 (PCT/CN2014/081127); ISA/CN.

* cited by examiner

PIXEL UNIT REDUCING VOLTAGE STRESS APPLIED TO DRIVING TRANSISTOR, PIXEL CIRCUIT HAVING THE PIXEL UNIT AND DRIVING METHOD THEREOF

The application is a U.S. National Phase Entry of International Application No. PCT/CN2014/081127 filed on Jun. 30, 2014, designating the United States of America and claiming priority to Chinese Patent Application No. 201310461039.9 filed on Sep. 30, 2013. The present application claims priority to and the benefit of the above-identified applications and the above-identified applications are incorporated by reference herein in their entirety.

TECHNICAL FIELD OF THE DISCLOSURE

The present disclosure relates the field of display technology, and particularly to a pixel unit, a pixel circuit comprising the pixel unit and a driving method thereof.

BACKGROUND

As a current type light-emitting element, Organic Light-Emitting Diode (OLED) has been increasingly applied in high performance Active Matrix Organic Light-Emitting Diode (AMOLED) display. With increasing of the size of the display, a conventional Passive Matrix Organic Light-Emitting Diode (PMOLED) display requires a shorter driving time for a single pixel, a larger transient current and thus higher power consumption. Meanwhile, a voltage drop on the nanometer indium-tin metal oxide line is too high due to the larger current application, such that operation voltage of OLED is too high and thus the operational efficiency thereof is decreased. These problems can be solved perfectly in a case in which the OLED current is inputted when switching transistors are scanned row by row in an AMOLED display.

When designing a backboard of AMOLED, a main problem to be solved is non-uniformity of luminance of OLED elements driven by various AMOLED pixel units.

At first, driving currents of light-emitting elements are provided by corresponding pixel units formed by Thin-Film Transistors (TFTs) in AMOLED. It is known that Low Temperature Poly Silicon (LTPS) TFTs or Oxide TFTs are mostly adopted. Compared with conventional amorphous-silicon TFTs, the LTPS TFTs and Oxide TFTs have higher mobility and more stable characteristics, and thus are more suitable to be applied in the AMOLED display. However, due to limitations of crystallization process, LTPS TFTs produced on a large-area glass substrate often show non-uniformity on electrical parameters such as threshold voltage, mobility and the like, and such non-uniformity may be converted to the driving current difference and luminance difference among OLED elements, that is, a mura phenomena appears, which may be perceived by human eyes. Although process of Oxide TFTs shows a better uniformity, similar to a-Si TFTs, a threshold voltage of Oxide TFT may drift under a high temperature or with a supplied voltage for a long time. Due to different display pictures, drifts of threshold voltages of TFTs in respective areas on a panel may be different from each other, which may cause display luminance difference. Such display luminance difference often renders an image sticking phenomenon since such display luminance difference has a relation to a previously displayed image.

Since the OLED light-emitting element is a element driven by a current (current-driven element), the threshold characteristic of the driving transistor in a pixel unit for driving the light-emitting element to emit light has a significant effect on the driving current and the ultimate display luminance. The threshold voltage of the driving transistor will drift under a voltage stress or light illumination, which causes the non-uniformity in the luminance of the resulted display.

SUMMARY

There is provided in embodiments of the present disclosure a pixel unit, a pixel circuit and a driving method thereof capable of solving the problem that the voltage threshold of the driving transistor in the existing pixel unit drifts.

According to an aspect of the present disclosure, there is provided a pixel unit comprising a light-emitting element and n driving sub-circuits; wherein n is a natural number and n>1; each of the n driving sub-circuits comprises a scan signal line for control-electrode, a switching transistor and a driving transistor; the switching transistor has a control electrode connected to the scan signal line for control-electrode, a first electrode connected to a data line, and a second electrode connected to a control electrode of the driving transistor; the driving transistor has a first electrode connected to a power supply line and a second electrode connected to a first electrode of the light-emitting element; and a second electrode of the light-emitting element is connected to a reference voltage terminal.

Optionally, each of the n driving sub-circuits further comprises a control transistor having a control electrode connected a timing sequence control module, a first electrode connected to a scan signal line for pixel-unit, and a second electrode connected to the control electrode of the switching transistor.

Optionally, the control electrode of each of the transistors is a gate, the first electrode of each of the transistors is a drain, and the second electrode of each of the transistors is a source.

Optionally, the first electrode of the light-emitting element is an anode and the second electrode of the light-emitting element is a cathode.

Optionally, the light-emitting element is a top-emission organic light-emitting diode.

Optionally, n=2.

According to another aspect of the embodiments of the present disclosure, there is provided a pixel circuit comprising a plurality of pixel units as described above arranged in a matrix, data lines and power supply lines, wherein the data lines are connected to the first electrodes of the switching transistors respectively; and the power supply lines are connected to the first electrodes of the driving transistors respectively.

Optionally, the pixel circuit further comprises a timing sequence control module connected to the control electrodes of the respective control transistors and configured to control the respective driving sub-circuits to drive the light-emitting elements sequentially according to timing sequence phases.

Optionally, the pixel circuit further comprises P scan signal lines for pixel-unit; wherein P is the number of the scan signal lines for pixel-unit and is a natural number, P>1; each of the scan signal lines for pixel-unit is connected to the first electrodes of all of the control transistors in a corresponding pixel unit.

According to another aspect of the embodiments of the present disclosure, there is provided a driving method for the above-described pixel circuit, wherein the method comprises: during a $(k-1)^{th}$ timing sequence phase, turning on $(k-1)^{th}$ switching transistors in respective rows of pixel units by a $(k-1)^{th}$ scan signal line for control-electrode; applying data voltages to $(k-1)^{th}$ driving transistors in the respective rows of pixel units by the data lines when the respective rows of pixel units are scanned, such that the $(k-1)^{th}$ driving transistors in the respective rows of pixel units are turned on and the power supply lines are connected to the light-emitting elements, so as to drive the light-emitting elements in the respective rows of pixel units to emit light sequentially; and during a $k^{th}$ timing sequence phase, turning on the $k^{th}$ switching transistors in the respective rows of pixel units by the $k^{th}$ scan signal lines for control-electrode; applying data voltages to the $k^{th}$ driving transistor in the respective rows of pixel units by the data lines when the respective rows of pixel units are scanned sequentially, such that the $k^{th}$ driving transistors in the respective rows of pixel units are turned on and the power supply lines are connected to the light-emitting elements, so as to sequentially drive the light-emitting elements in the respective rows of pixel units to emit light; and so on until k=n, wherein k is a serial number of the timing sequence phase in a same operation cycle and $1 \leq k \leq n$.

Optionally, the method further comprises switching the respective control transistors according to the timing sequence phases by the timing sequence control module; and connecting the respective scan signal lines for control-electrode sequentially to switch the respective driving sub-circuits to drive the light-emitting elements to emit light according to the timing sequence phases.

Optionally, the duration of each of the timing sequence phases is the time of a frame of image.

In the embodiments of the present disclosure, the design of n (n>1) driving sub-circuits for driving the light emitting element to emit light is adopted, such that the respective driving sub-circuits can drive the light emitting element to emit light according to the timing sequence phases, thus the problem that in the existing pixel unit, the physical characteristics of a single driving transistor is damaged due to a long time voltage stress on the single driving transistor during the driving process when the light-emitting element is driven by the single driving transistor all the time. Such physical characteristic damage is a main reason for the resulted voltage threshold drift of the driving transistor. The time of the voltage stress applied to the driving transistor in each of the driving sub-circuits can be effectively shorten when the timing sequence control module is adopted to control the switching among the multiple driving sub-circuits according to the timing sequence phases, such that the problem that the display quality is decreased due to the voltage threshold drift of the driving transistor can be solved, the driving effect of the light-emitting element can be ensured, and the life time of the pixel unit can be prolonged.

The design of the timing sequence control module is adopted in the embodiments of the present disclosure, wherein the respective control transistors are controlled to be turned on or off according to the timing sequence phases, such that the driving switching can be achieved among the respective driving sub-circuits according to the order of the timing sequence phases, the accuracy of the switching can be ensured, and ratio of incorrect operation on the driving switching can be reduced.

BRIEF DESCRIPTION OF THE DRAWINGS

Optional description will be given to embodiments of the present disclosure in connection with accompanying drawings.

DETAILED DESCRIPTION

Hereinafter, the technical solutions in the embodiments of the present disclosure will be described clearly and thoroughly with reference to the accompanying drawings of the embodiments of the present disclosure. Obviously, the embodiments as described are only some of the embodiments of the present disclosure, and are not all of the embodiments of the present disclosure. All other embodiments obtained by those skilled in the art based on the embodiments in the present disclosure without paying any inventive labor should fall into the protection scope of the present disclosure.

First Embodiment

Figure 1:
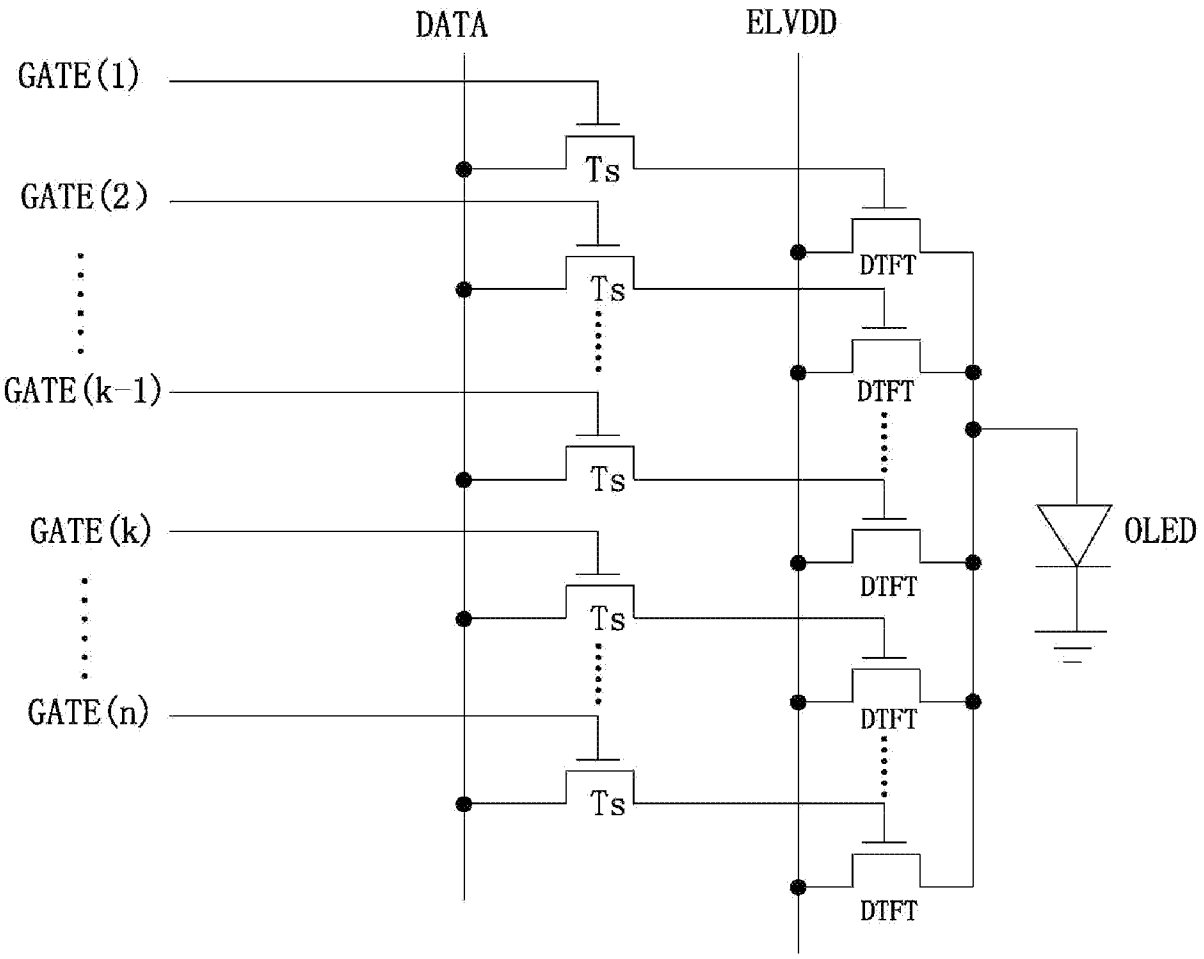
FIG. 1 is a schematic diagram of a circuit configuration for a pixel unit according to a first embodiment of the present disclosure.

As shown in FIG. 1, pixel units according the embodiment of the present disclosure are mainly configured to drive respective light-emitting elements in the AMOLED display. Each of the pixel units comprises a light-emitting element and n driving sub-circuits for driving the light-emitting element; wherein n is the number of the driving sub-circuits and is a natural number, n>1.

Each of the driving sub-circuits comprises a scan signal line for control-electrode GATE, a switching transistor Ts and a driving transistor DTFT; the switching transistor Ts has a control electrode connected to the scan signal line for control-electrode, a first electrode connected to a data line, and a second electrode connected to a control electrode of the driving transistor DTFT. The driving transistor DTFT has a first electrode connected to a power supply line ELVDD and a second electrode connected to a first electrode of the light-emitting element OLED.

A second electrode of the light-emitting element OLED is connected to a reference voltage terminal. In FIG. 1, GATE (1) refers to the scan signal line for control-electrode corresponding to a first timing sequence phase; GATE(2) refers to the scan signal line for control-electrode corresponding to a second timing sequence phase; GATE(k−1) refers to the scan signal line for control-electrode corresponding to a $(k-1)^{th}$ timing sequence phase; GATE(k) refers to the scan signal line for control-electrode corresponding to a $k^{th}$ timing sequence phase; in the same manner, GATE(n) refers to the scan signal line for control-electrode corresponding to an $n^{th}$ timing sequence phase, k=n at this time. k refers to a serial number of receptive timing sequence phases in a same operational cycle and is a natural number, $1 \leq k \leq n$. Each of the driving sub-circuits is configured to drive the light-emitting element to emit light during a corresponding timing sequence phase among the respective timing sequence phases.

In the present embodiment, the control electrode of respective transistors is a gate, the first electrode of respective transistors is a drain, and the second electrode of respective transistors is a source; the first electrode of the light-emitting element is an anode and the second electrode of the light-emitting element is a cathode; the light-emitting element is a top-emission organic light-emitting diode. Of course, those skilled in the art should understand that the source can be used as the first electrode and the drain can be used as the second electrode since the source and the drain are interchangeable in structure. Moreover, depending on the connection manner of the light-emitting element, the cathode can be used as the first electrode and the anode can be used as the second electrode.

As shown in FIG. 1, there are n driving sub-circuits as described above in the present embodiments, wherein n>1. Accordingly, there are n timing sequence phases in a same operational cycle of the pixel unit, that is, the number of the driving sub-circuits is equal to the number of the timing sequence phases. The serial number of respective timing sequence phases in the same operational cycle is defined as k, which is a natural number, $1 \leq k \leq n$. Since the number of the driving sub-circuits is equal to the number of the timing sequence phases, the serial number of respective driving sub-circuits is also defined as k, and exemplary description will be given as follows.

When the serial number k of the timing sequence phase is 1, a corresponding first driving sub-circuit drives the light-emitting element to operate; when the serial number k of the timing sequence phase is 2, a corresponding second driving sub-circuit drives the light-emitting element to operate; in the same manner, when the serial number k of the timing sequence phase is n, a corresponding $n^{th}$ driving sub-circuit drives the light-emitting element to operate. To this end, when k=n, the operation that the respective driving sub-circuits sequentially drive the light-emitting element to emit light in the order of the timing sequence phases in this cycle is completed. In the embodiments of the present disclosure, each of the driving sub-circuits has a corresponding timing sequence phase, that is, the number and the serial numbers of the driving sub-circuits are matched with the number and the serial numbers of the timing sequence phases in the embodiments of the present disclosure respectively. Meanwhile, in the embodiments of the present disclosure, the duration of one certain timing sequence phase is the operation time during which the driving sub-circuit corresponding to the serial number of the timing sequence phase drives the light-emitting element to emit light. For example, for the $k^{th}$ timing sequence phase ($1 \leq k \leq n$), the operation time of its corresponding $k^{th}$ driving sub-circuit is $t_k$, and thus the duration of the $k^{th}$ timing sequence phase is also represented as $t_k$. In the embodiments of the present disclosure, in order to ensure that the light-emitting element is driven uniformly by the driving sub-circuits during respective timing sequence phases, the duration of each of the respective timing sequence phases is set as a same time length.

Figure 2:
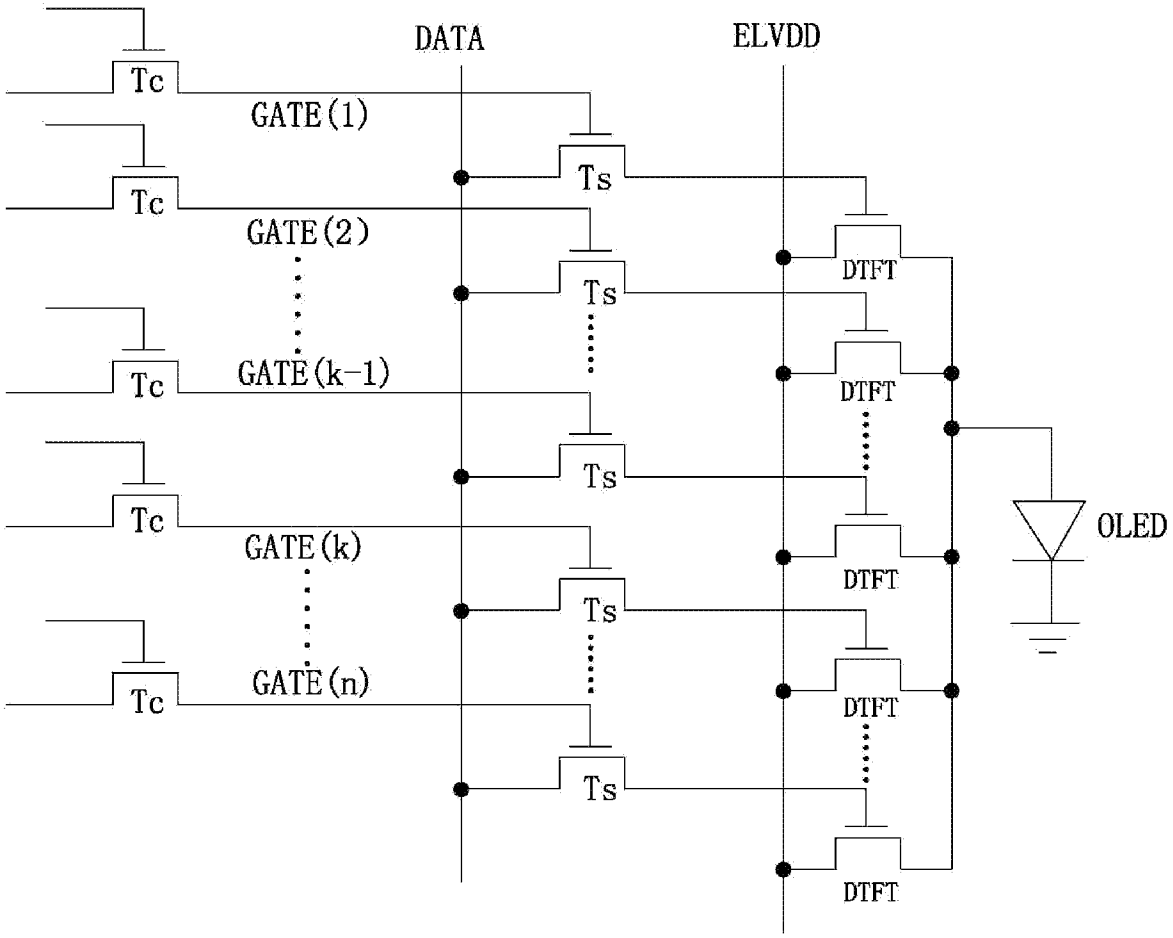
FIG. 2 is a schematic diagram of a circuit configuration for a pixel unit according to the first embodiment of the present disclosure.

As shown in FIG. 2, each of the driving sub-circuits further comprises a control transistor Tc having a control electrode connected a timing sequence control module, a first electrode connected to a scan signal line for pixel-unit, and a second electrode connected to the control electrode of the switching transistor.

The first electrodes of the respective driving transistors of the pixel unit in the embodiments of the present disclosure are connected to the power supply line, which is connected to an operational power supply externally and supplies an operational voltage to the light-emitting element. The light-emitting element in the embodiments of the present disclosure is an Organic Light Emitting Diode (OLED element).

The reference voltage terminal in the embodiments of the present disclosure is configured to be connected to the second electrode of the light-emitting element and to supply a reference voltage to the light-emitting element. For example, the reference voltage terminal is connected to a neutral line or a ground line to supply a neutral potential, a negative voltage, etc.

In the embodiments of the present disclosure, the respective driving transistors are n type TFT driving transistors which may be enhancement type TFTs (the threshold voltage thereof is positive) or depletion type TFTs (the threshold voltage thereof is negative). The driving transistor, the switching transistors and the control transistors are all Field Effect Transistors.

In the embodiments of the present disclosure, The design of at least two driving sub-circuits for driving the light emitting element to emit light is adopted, such that the respective driving sub-circuits can drive the light emitting element to emit light according to the respective timing sequence phases, thus the problem in the existing pixel unit that physical characteristics of a single driving transistor is damaged due to a long time voltage stress applied to the single driving transistor during the driving process in which the light-emitting element is driven by the single driving transistor all the time. Such physical characteristic damage is a main reason for the resulted voltage threshold drift of the driving transistor. The time of the voltage stress applied to the driving transistor in each of the driving sub-circuits can be effectively shorten when the timing sequence control module is adopted to control the switching among the multiple driving sub-circuits according to the timing sequence phases, such that the problem that the display quality is decreased due to the voltage threshold drift of the driving transistor can be solved, the driving effect of the light-emitting element can be ensured, and the life time of the pixel unit can be prolonged.

In the embodiments of the present disclosure, it is assumed that the pixel circuit comprises n driving sub-circuits (wherein n is the number of the driving sub-circuits and n>1), that is, the pixel unit has n driving transistors. During the process in which the pixel unit drives the light-emitting element, for one of the driving sub-circuits, the time of the voltage stress applied to the driving transistor in the driving sub-circuit for driving the light-emitting element to emit light is generally 1/n of the time of the voltage stress applied to a single driving transistor if the single driving transistor is adopted to drive the light-emitting element. In the same manner, the time of the voltage stress on each of the n driving transistors is reduced to 1/n of the time of the voltage stress on a single driving transistor if the single driving transistor is adopted to drive the light-emitting element, such that the problem that the voltage threshold drift of the driving transistor results from the long time voltage stress on the driving transistor can be solved, thus the life time of the driving transistor can be prolonged, and the display quality can be improved.

In theory, the number of the driving sub-circuits included in the pixel unit can be at least two. However, the larger the number of the driving sub-circuits is, the lower the possibility that the voltage thresholds of the respective driving transistors in the pixel unit drift is. Furthermore, when more driving sub-circuits are adopted, even if one or several driving transistors fail, it can be ensured that the light-emitting element can be driven by the remaining driving transistors sequentially according to the timing sequence phases so as to maintain to emit light normally. However, the increasing of the number of the driving sub-circuits is limited by some conditions, for example the number depends on the size and specification of the display panel to which the pixel unit is applied and the number of the light-emitting elements included in the display panel. The more the light-emitting elements are, the more the transistors required are. The more the transistors arranged on the display panel are, the larger the density of the transistors arranged on the same display panel is, which may affect the aperture ratio of the display panel and then affect the display luminance of the display panel. Therefore, when the number of the driving sub-circuits is larger, the display panel formed by the pixel units according to the embodiments of the present disclosure should be a top-emission AMOLED display.

The top-emission AMOLED display refers to an AMOLED display comprising a first electrode layer, an organic electro-luminescence layer and a second electrode layer, wherein the organic electro-luminescence layer is arranged on the first electrode layer, and the second electrode layer is arranged on the organic electro-luminescence layer. Furthermore, the second electrode layer is located at the light emission side of the AMOLED display and the first electrode layer is located at the light reflective side of the AMOLED display, a plurality of pixel units are arranged under the first electrode layer and are connected to the first electrode of the light-emitting element. The detailed description of the top-emission AMOLED display in the embodiments of the present disclosure is omitted herein.

In the above-described top-emission AMOLED display, the organic electro-luminescence layer corresponding to the light-emitting element emit light under the driving of the pixel unit, the light is firstly reflected by the reflective side of the first electrode layer, and the reflected light is then transmitted through the second electrode layer to exit out. Therefore, luminance of such AMOLED display only has relation to the aperture ratio of the second electrode layer, and the first electrode layer only needs to have a high light reflectivity to satisfy the requirement on the light reflection. Since the pixel units are arranged under the first electrode layer correspondingly, there is no effect on the light reflection of the first electrode layer even if the number of the transistors in the pixel unit is large and the aperture ratio of the first electrode layer is small, and in turn there is no effect on the display luminance of the AMOLED display and the life time of the organic electro-luminescence layer.

Second Embodiment

A pixel circuit according to this embodiment is an improvement to that according to the first embodiment, the disclosure in the first embodiment can also be applied to the second embodiment and repeated description is omitted herein.

Figure 3:
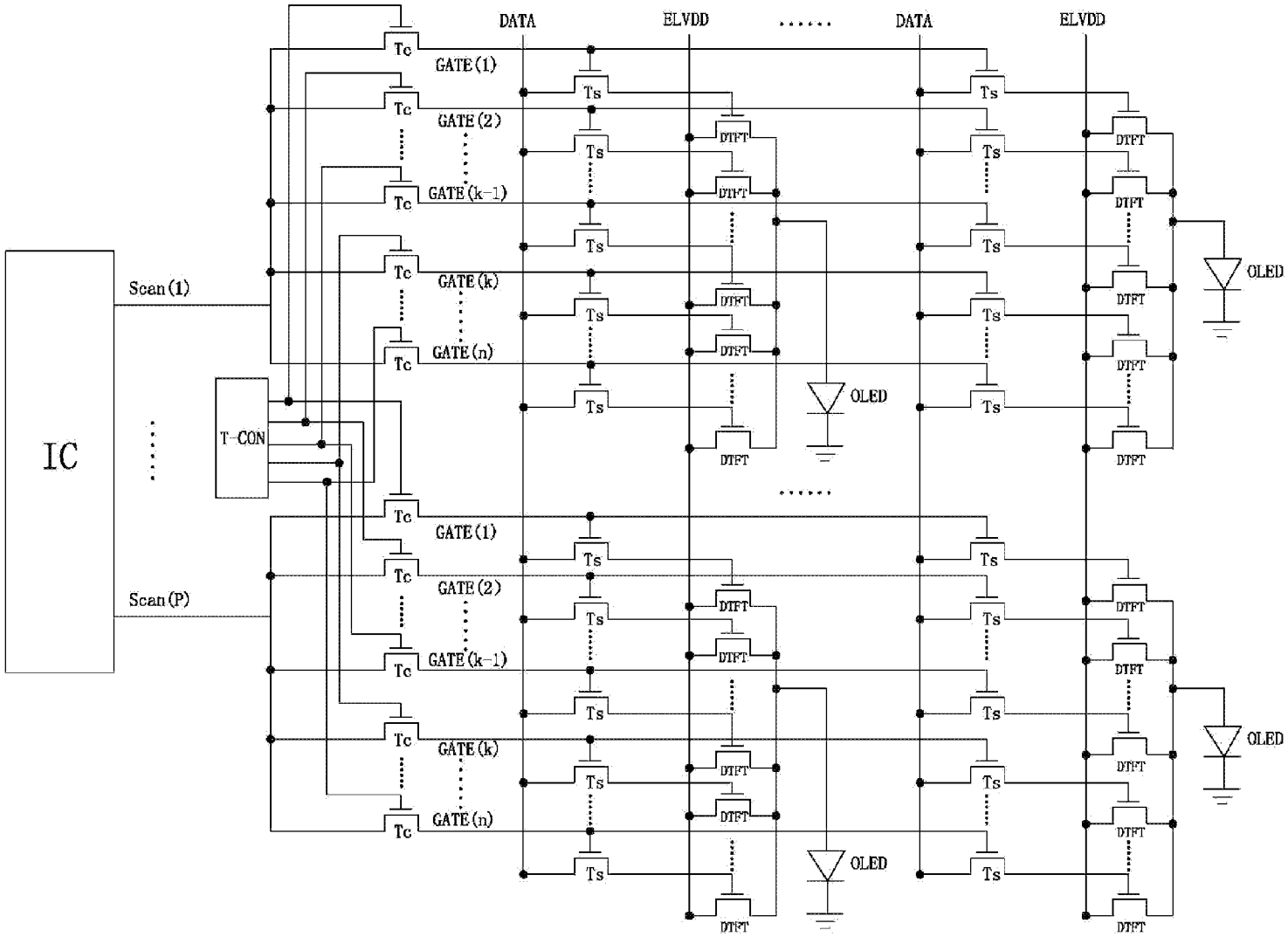
FIG. 3 is a schematic diagram of a circuit configuration for a pixel unit according to a second embodiment of the present disclosure.

As shown in FIG. 3, the pixel circuit in the embodiments of the present disclosure is mainly configured to control and drive all of the light-emitting elements in the AMOLED display.

The pixel circuit comprises a plurality of pixel units as described in the first embodiment, data lines and power supply lines, wherein the data lines are connected to the first electrodes of the switching transistors respectively; and the power supply lines are connected to the first electrodes of the driving transistors respectively.

The pixel circuit in the present embodiment further comprises a timing sequence control module T-CON connected to the control electrodes of the control transistors respectively and configured to control the driving sub-circuits respectively to drive the light-emitting elements sequentially according to the timing sequence phases.

When the control transistors are turned on sequentially according to the timing sequence phases, the scan signal lines for control-electrode connected to the control transistors respectively transmit sequentially pulse scan voltages to the switching transistors connected thereto respectively, and the pulse scan voltages function as the ON voltage of the switching transistors respectively.

In this embodiment, the control transistors are controlled to be turned on or off by the timing sequence control module according to the timing sequence phases, such that the driving switching can be achieved among the respective driving sub-circuits according to the order of the timing sequence phases, accuracy of the switching can be ensured, and ratio of incorrect operation on the driving switching can be reduced.

In the present embodiment, the pixel circuit further comprises P scan signal lines for pixel-unit Scan; wherein P is the number of the scan signal lines for pixel-unit and is a natural number, P>1. Each of the scan signal lines for pixel-unit is connected to the first electrodes of all of the control transistors in a corresponding pixel unit, that is, all of the control-electrode-scan signal lines in the respective pixel units are connected to a corresponding scan signal line for pixel-unit. The respective scan signal lines for pixel-unit are connected to an IC driving circuit which is configured to drive the pixel circuit to operate. When the light-emitting elements in one or several pixel units needs to operate, that is, when the one or several pixel units are in their timing sequence phases, the IC driving circuit sends pulse signals to the scan signal lines for pixel-unit connected to the one or several pixel units. The timing sequence control module controls, according to the timing sequence, to turn on the control transistor which needs to be turned on during the timing sequence phase. The pulse signal is transmitted to the switching transistor through the control transistor corresponding to the timing sequence phase, such that the light-emitting element is driven by one driving sub-circuit.

As for FIG. 3, Scan(1) is a first scan signal line for pixel-unit, and Scan(P) is a $P^{th}$ scan signal line for pixel-unit, P>1. The IC driving circuit supplies the switching transistors corresponding to the timing sequence phase in the respective pixel units with the pulse voltages required for turning on the switching transistors during the respective timing sequence phases, so as to control the driving sub-circuit including the switching transistors to drive the light-emitting elements to emit light during the duration of the timing sequence phase.

It should be noted that there is no distinction between the first electrode and the second electrode of each of the transistors in the embodiments of the present disclosure. For example, the first electrode of the driving transistor can be also referred to as the second electrode of the driving transistor, and accordingly the second electrode of the driving transistor can be referred to as the first electrode.

Figure 4:
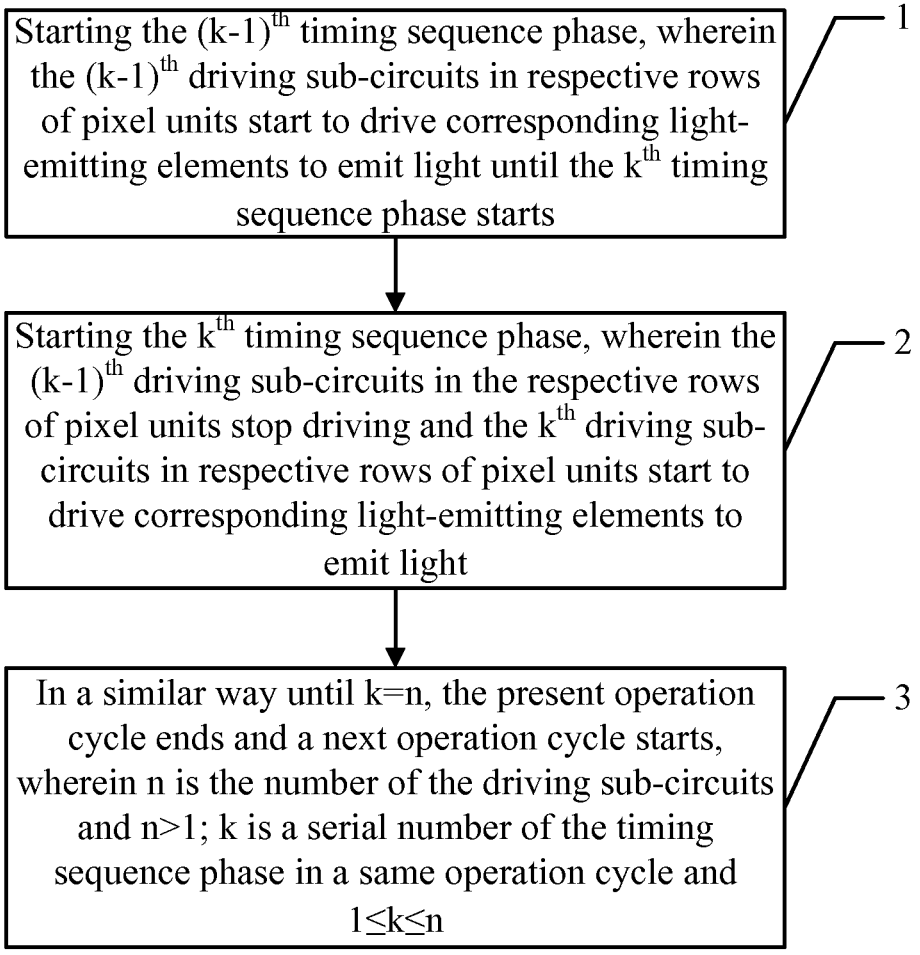
FIG. 4 is a flowchart of steps of a driving method according to the second embodiment of the present disclosure.
Figure 5:
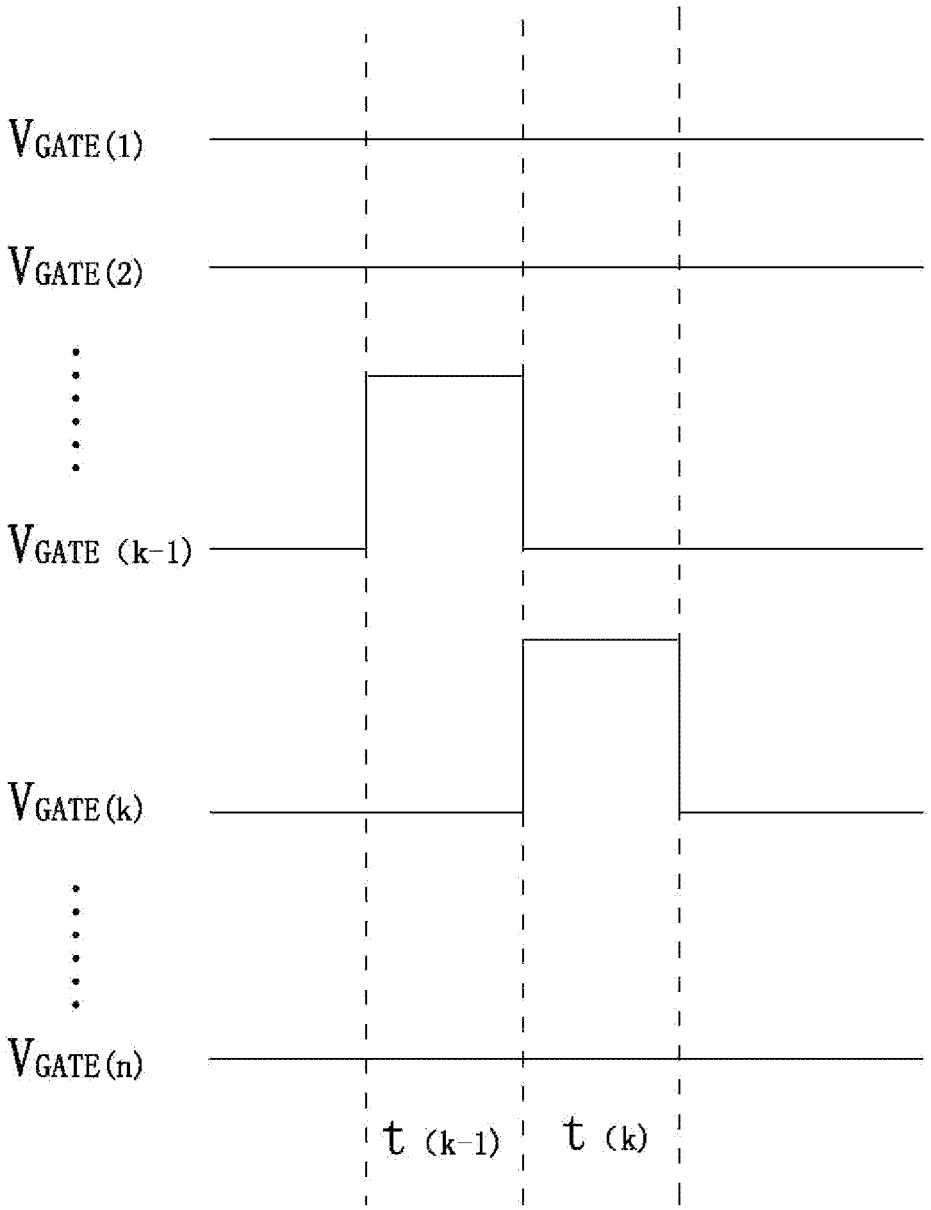
FIG. 5 is a schematic diagram of the controlling in the timing sequence phase of the driving method according to the second embodiment of the present disclosure.

Referring to FIG. 4 and FIG. 5, there is further provided a driving method implemented in the above-described pixel circuit. The method will be described below with reference to FIG. 5. In this figure, $V_{GATE(1)}$ is a potential waveform outputted from the first control-electrode-scan signal line, $V_{GATE(2)}$ is a potential waveform outputted from the second control-electrode-scan signal line, $V_{GATE(k-1)}$ is a potential waveform outputted from the $(k-1)^{th}$ control-electrode-scan signal line, $V_{GATE(k)}$ is a potential waveform outputted from the $k^{th}$ control-electrode-scan signal line, and $V_{GATE(n)}$ is a potential waveform outputted from the $n^{th}$ control-electrode-scan signal line (k=n), wherein $t_{(k-1)}$ is the $(k-1)^{th}$ timing sequence phase, and $t_k$ is the $k^{th}$ timing sequence phase.

The method comprises:

1. Starting the $(k-1)^{th}$ timing sequence phase, wherein the $(k-1)^{th}$ driving sub-circuits in respective rows of pixel units start to drive; the timing sequence control module controls the $(k-1)^{th}$ control transistors for the respective rows of pixel units to make the $(k-1)^{th}$ scan signal lines for control-electrode for the respective rows of pixel units at a high level and the other scan signal lines for control-electrode at a low level; the $(k-1)^{th}$ switching transistors in the respective rows of pixel units are turned on by the $(k-1)^{th}$ scan signal lines for control-electrode respectively; data voltages are applied to the $(k-1)^{th}$ driving transistors in the respective rows of pixel units by the data lines, such that the $(k-1)^{th}$ driving transistors in the respective rows of pixel units are turned on and the power supply lines are connected to the light-emitting elements, so as to drive the light-emitting elements in the respective rows of pixel units to emit light, until the $k^{th}$ timing sequence phase starts.

2. Starting the $k^{th}$ timing sequence phase, wherein the $(k-1)^{th}$ driving sub-circuits in the respective rows of pixel units stop driving, the $(k-1)^{th}$ scan signal lines for control-electrode for the respective rows of pixel units turn off the $(k-1)^{th}$ switching transistors and the $(k-1)^{th}$ driving transistors in the respective rows of pixel units; meanwhile, the $k^{th}$ driving sub-circuits in the respective rows of pixel units start to drive; the timing sequence control module controls the $k^{th}$ control transistors for the respective rows of pixel units to make the $k^{th}$ scan signal lines for control-electrode for the respective rows of pixel units at a high level and the other scan signal lines for control-electrode at a low level; the $k^{th}$ switching transistors in the respective rows of pixel units are turned on by the $k^{th}$ scan signal lines for control-electrode; data voltages are applied to the $k^{th}$ driving transistors in the respective rows of pixel units by the data lines, such that the $k^{th}$ driving transistors in the respective rows of pixel units are turned on and the power supply lines are connected to the light-emitting elements, so as to drive sequentially the light-emitting elements in the respective rows of pixel units to emit light.

3. In a similar way until k=n, the present operation cycle ends and a next operation cycle starts, wherein n is the number of the driving sub-circuits and n>1; k is a serial number of the timing sequence phase in a same operation cycle and $1 \leq k \leq n$.

In the embodiments of the present disclosure, prior to the driving phase of the driving sub-circuits, when starting the respective timing sequence phases, the timing sequence control module turns on the control transistors for the driving sub-circuits corresponding to the timing sequence phase sequentially according to the timing sequence phase, such that the scan signal lines for control-electrode in the respective driving sub-circuits corresponding to different timing sequence phases are powered on sequentially according to the timing sequence phases, and the timing sequence control module controls the respective driving sub-circuits to, sequentially according to the respective timing sequence phases, drive the light-emitting elements to emit light; and the duration of each of the timing sequence phases is the time of a frame of image.

The present application claims the priority of a Chinese patent application with an application No. 201310461039.9 filed on Sep. 30, 2013, the disclosure of which is entirely incorporated as one part of the present application herein by reference.

What is claimed is:

1. A pixel unit comprising a light-emitting element and n driving sub-circuits; wherein n is a natural number and n>1, wherein each of the n driving sub-circuits comprises a scan signal line for control-electrode, a switching transistor, a driving transistor, and a control transistor; the switching transistor has a control electrode connected to the scan signal line for control-electrode, a first electrode connected to a data line, and a second electrode connected to a control electrode of the driving transistor; the driving transistor has a first electrode connected to a power supply line and a second electrode connected to a first electrode of the light-emitting element; and a second electrode of the light-emitting element is connected to a reference voltage terminal;

a second electrode of the control transistor is connected to the scan signal line for control-electrode;

control electrodes of control transistors in the n driving sub-circuits are configured to receive different timing sequence signals respectively, and first electrodes of all of the control transistors in the n driving sub-circuits are connected to a same scan line for the pixel unit so as to share a driving signal corresponding to a same scan signal between the n driving sub-circuits and reduce a time of a voltage stress applied to the driving transistor in each of the n driving sub-circuits;

wherein during a $k^{th}$ timing sequence phase, a $k^{th}$ driving sub-circuit of the n driving sub-circuits is configured to drive the light-emitting element to emit light, and other driving sub-circuits are turned off, wherein k is increased from 1 to n.

2. The pixel unit of claim 1, wherein the control electrode of each of the switching transistor, the driving transistor and the control transistor is a gate, the first electrode of each of the switching transistor, the driving transistor and the control transistor is a drain, and the second electrode of each of the switching transistor, the driving transistor and the control transistor is a source.

3. The pixel unit of claim 1, wherein the first electrode of the light-emitting element is an anode and the second electrode of the light-emitting element is a cathode.

4. The pixel unit of claim 1, wherein the light-emitting element is a top-emission organic light-emitting diode.

5. The pixel unit of claim 1, wherein n=2.

6. A pixel circuit comprising a plurality of pixel units of claim 1 arranged in a matrix, data lines and power supply lines, wherein the data lines are connected to the first electrodes of the switching transistors respectively; and the power supply lines are connected to the first electrodes of the driving transistors respectively.

7. The pixel circuit of claim 6, further comprising:

a timing sequence control module connected to the control electrodes of the respective control transistors and configured to control the respective driving sub-circuits to drive the light-emitting elements sequentially according to timing sequence phases.

8. The pixel circuit of claim 7, further comprising:

P scan lines for pixel-unit; wherein P is the number of the scan lines for pixel-unit and is a natural number, and P>1; each of the scan lines for pixel-unit is connected to the first electrodes of all of the control transistors in a corresponding pixel unit.

9. A driving method for the pixel circuit of claim 7, comprising:

during a $(k-1)^{th}$ timing sequence phase, turning on $(k-1)^{th}$ switching transistors in respective rows of pixel units by a $(k-1)^{th}$ scan signal line for control-electrode; applying data voltages to $(k-1)^{th}$ driving transistors in the respective rows of pixel units by the data lines when the respective rows of pixel units are scanned sequentially, such that the $(k-1)^{th}$ driving transistors in the respective rows of pixel units are turned on and the power supply lines are connected to the light-emitting elements, so as to drive the light-emitting elements in the respective rows of pixel units to emit light sequentially; and during the $k^{th}$ timing sequence phase, turning on the $k^{th}$ switching transistors in the respective rows of pixel units by a $k^{th}$ scan signal line for control-electrode; applying the data voltages to the $k^{th}$ driving transistors in the respective rows of pixel units by the data lines when the respective rows of pixel units are scanned sequentially, such that the $k^{th}$ driving transistors in the respective rows of pixel units are turned on and the power supply lines are connected to the light-emitting elements, so as to sequentially drive the light-emitting elements in the respective rows of pixel units to emit light; and repeating the above until k=n, wherein k is a serial number of the timing sequence phase in a same operation cycle and $1 \leq k \leq n$.

10. The driving method for the pixel circuit of claim 9, further comprising:

switching the respective control transistors sequentially according to the timing sequence phases by the timing sequence control module; and turning on the respective scan signal lines for control-electrode sequentially to switch the respective driving sub-circuits to drive the light-emitting elements to emit light according to the timing sequence phases.

11. The driving method for the pixel circuit of claim 9, wherein a duration of each of the timing sequence phases is a time of a frame of image.

12. The pixel circuit of claim 6, wherein the control electrode of each of the switching transistor, the driving transistor and the control transistor is a gate, the first electrode of each of the switching transistor, the driving transistor and the control transistor is a drain, and the second electrode of each of the switching transistor, the driving transistor and the control transistor is a source.

13. The pixel circuit of claim 6, wherein the first electrode of the light-emitting element is an anode and the second electrode of the light-emitting element is a cathode.

14. The pixel circuit of claim 6, wherein the light-emitting element is a top-emission organic light-emitting diode.

15. The pixel circuit of claim 6, wherein n=2.

* * * * *